United States Patent [19]

Baker et al.

[11] 4,273,521

[45] Jun. 16, 1981

[54] DRIVE ARRANGEMENT

[75] Inventors: Donald E. Baker; David W. Bouette, both of Macclesfield, England

[73] Assignee: E. T. Oakes Limited, Cheshire, England

[21] Appl. No.: 10,917

[22] Filed: Feb. 9, 1979

[30] Foreign Application Priority Data

Feb. 10, 1978 [GB] United Kingdom ..... 5542/78

[51] Int. Cl.[3] ..... F04C 2/16

[52] U.S. Cl. ..... 418/48

[58] Field of Search ..... 418/48, 220

[56] References Cited

U.S. PATENT DOCUMENTS 2,483,370 9/1949 Moineau ..... 418/48

2,505,136 4/1950 Moineau ..... 418/48

FOREIGN PATENT DOCUMENTS 1403941 1/1969 Fed. Rep. of Germany .

1271576 8/1961 France .

*Primary Examiner*—Herbert Goldstein

*Attorney, Agent, or Firm*—Lewis H. Eslinger

[57] ABSTRACT

A helical gear pump, compressor or motor including an inner member with an external helical gear form having n starts, an outer member with a cooperating internal gear form having n±1 starts. The inner member is provided with a first externally toothed gear and the outer member is provided with a second externally toothed gear. A geared connection between the first and second external gears synchronizes the rotation of the inner and outer members so that they can rotate relative to one another independently of any contact between the helical gear forms of the inner and outer members.

5 Claims, 2 Drawing Figures

DRIVE ARRANGEMENT

The present invention relates to helical gear pumps, compressors and motors.

The invention is particularly concerned with drive arrangements suitable for causing the relative movement between the elements of a helical gear pump, so that the inner member is caused to rotate about its axis and at the same time to execute a motion in a direction transverse to its axis.

Conventionally gear pumps or motors, such as described and illustrated in British Pat. No. 400,508, are driven by a drive shaft which has, at each end, a universal joint. More recently it has been proposed to drive the rotor by means of a flexible drive shaft which is provided on its exterior surface with a protective coating. The purpose of the protective coating is to reduce the chance of the flexible drive shaft failing as a result of corrosion fatigue.

Both of these conventional types of arrangement are necessarily rather bulky. Thus, the length of the drive shaft, whether it be a flexible drive shaft, or a drive shaft provided with universal joints, is often several times the length of the pump element itself.

It has also been proposed, in German Offenlegungsschrift No. 1944562 to provide a drive arrangement which includes a ring gear, the rotor of the pump having an axially extending spigot which engages in a recess in a drive member, a portion of a spigot being externally toothed, these teeth engaging with the internal teeth of the ring gear. This had the advantage of reducing the overall axial length but the construction illustrated in this German Specification has not been commercialised because it does not appear to be a practical possibility.

It has further been proposed, in U.S. Pat. No. 1,892,217 to provide an internally toothed ring gear secured inside the housing of the pump, at the inlet or outlet end, and to have meshing with this a pinion mounted on a crank and carried by the rotor. The purpose of this arrangement is to provide a separate geared connection between the rotor and stator to reduce wear between the rotor and stator by synchronizing the rotation. This arrangement is inpracticable for two reasons. Firstly, for normal eccentricities of the helical gear forms, the size of the ring gear would have to be too small to enable sufficiently large teeth to be provided on the ring gear and pinion to take the torques which are necessary to drive a pump or compressor, or to receive power from a motor. Secondly, the ring gear and pinion are located in the material being pumped which is most unsatisfactory.

According to the present invention, we provide a helical gear pump, compressor or motor, including an inner member with an external helical gear form having n starts; an outer member with a cooperating internal gear form having $n \pm 1$ starts; at least one shaft rotatable about a first axis which is connected to said inner member for rotation therewith; a support for supporting the outer member for rotation about a second axis laterally spaced from said first axis; and a geared connection between said inner and outter members, whereby the inner and outer members can rotate synchronously without any drive or contact between the helical gear forms of the inner and outer members.

Such a construction is capable of operating at a high speed with a dry "volute" defined between the inner and outer members. With the present invention, the volute defined between the inner and outer members is swept without the need for any orbiting motion of the inner member as has been necessary in the prior art. Instead, the inner and outer members both rotate about their own axis with their motion suitably synchronized by the geared connection between them. The fact that the inner and outer members undergo purely rotational motions about their own axes, which are fixed in space, and itself helps to avoid the generation of a large out of balance force and also makes it rather easy to design the geared connection to avoid dynamic balance problems with the latter.

The invention thus has the advantage that unlike the prior art, it can be used, for example, for high speed pumping of gaseous fluids.

Preferably, the inner and outer members are interconnected by a gear train located externally of the outer member. The fact that the gear train is external to the outer member means that the sizes of the gears can be chosen to be sufficiently large to take the necessary torques to drive the pump or compressor or to receive a drive from a motor, the geared connection can therefore be sufficiently robust and can be located so that it is not in contact with the fluid being pumped or compressed, or the driving fluid used in the motor. Advantageously, the inner member is mounted in bearings in each of its ends. The use of such an arrangement, which is made possible by the structure of the invention, enables the inner member to be driven with much higher positional precision than is possible with the rotor supported only at one end or via universal joints. This further facilitates operation of the pump, compressor or motor at high speeds. This feature is possible because of the way in which the relative motion of the inner and outer members required to sweep out the volute is produced, i.e. by having them rotating about their own axes which are offset relative to one another.

The structure according to the invention obviates the need for a resilient stator, so that the "stator", that is the outer member, can now be made in a rigid material, e.g. a metal or even a ceramic which enables the apparatus to be used to handle very hot fluids.

In one particular construction according to the present invention, the inner and outer members are constructed so that the helical gear formations thereon have lefthand pitch at one end and a right hand pitch at the other end and a fluid connection is provided in the outer member at the location of the change of pitch, and a further fluid connection is provided at each axial end of the outer member. The fluid to be pumped is thus introduced either at the center of the pump axially outwardly or at the end and pumped axially inwardly to be discharged at the center. This has the advantage that it overcomes the necessity for providing bearings to take axial load, because the axial loads acting on the inner member or rotor cancel one another out. This feature also has the advantage, when applied to a compressor for air or gas, that as the air or gas can be fed into the compressor at both its ends, no sealing problems arise.

It is also contemplated that either with a conventional single type direction of pumping or in the double arrangement mentioned in the previous paragraph, the helical gear formations of the inner and outer members are of cooperating tapered cross-section. This produces an increased pumping effect along the axial length of the inner and outer members. This will be particularly advantageous if the machine is used as a compressor.

In order that the invention may more readily be understood, the following description is given, merely by way of example, reference being made to the accompanying drawings, in which:

FIG. 1 illustrates a helical gear pump.

Figure 2:
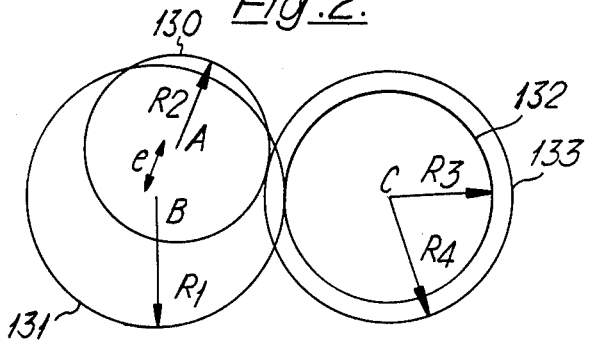
FIG. 2 shows, in a purely schematic manner, a gear train arrangement for a helical gear pump, compressor or motor, according to the invention.

FIG. 2 illustrates a further construction according to the invention. A frame 100 includes two large bearing sleeves 101, and two small bearing sleeves 102, these bearing sleeves being arranged at each end of the frame. Bearings 103 are arranged in the two bearing sleeves 101 and bearings 104 in the two bearing sleeves 102. The axis of the bearings 103 is disposed at a distance from the axis of the bearings 104 for a reason to be explained later.

Figure 1:
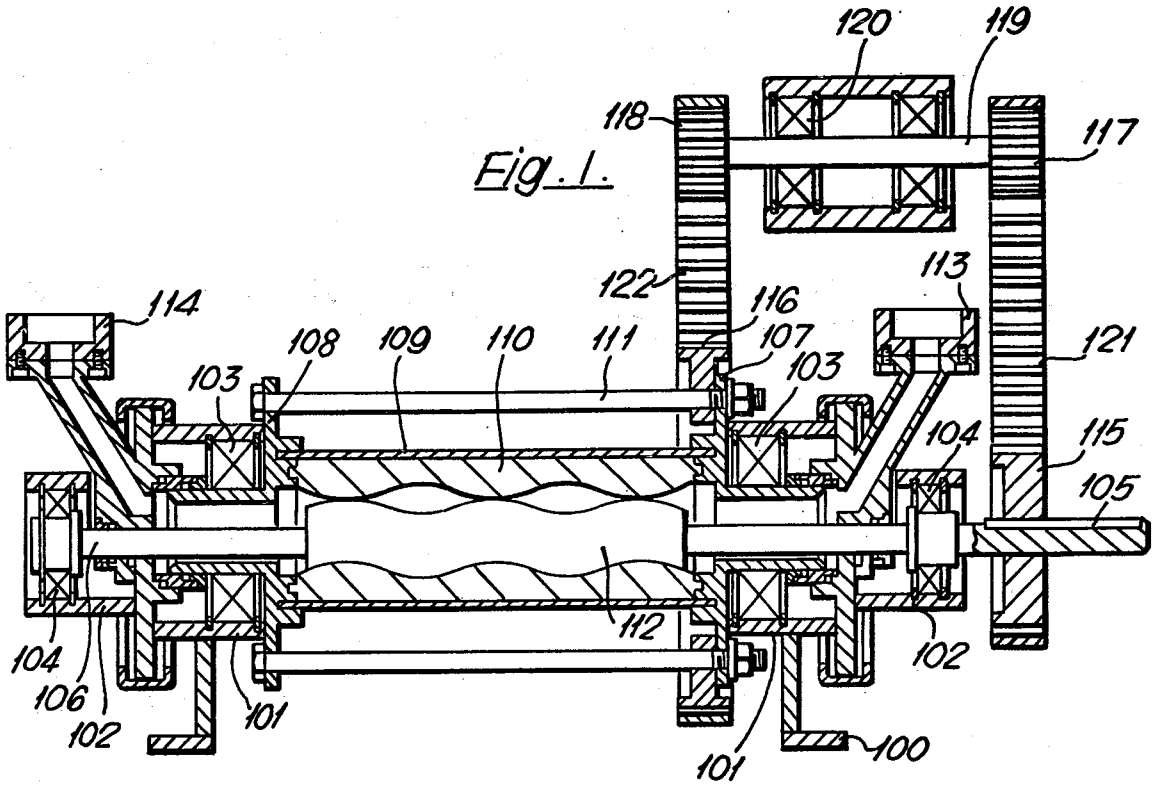
FIG. 1 is an axial cross-section through an embodiment of helical gear pump according to the invention.

Bearings 104 are used to mount a drive shaft 105 and an idler shaft 106. Bearings 103, on the other hand mount the two end plates 107 and 108 of a helical gear pump barrel 109 having a helical gear pump outer member or "stator" 110 therewithin. The end plates 107 and 108 are held together by a number of circumferentially spaced tie bars 111. The rotor 112 and "stator" 110 are thus each rotatable about their own longitudinal axes, which as FIG. 1 shows, are offset relative to one another. The resultant relative motion of the inner and outer members when they rotate causes the volute to be swept out.

The drive shaft 104 and the idler shaft 106 are keyed to the inner member or rotor 112 of the helical gear pump.

A conventional inlet and outlet 113 and 114 are provided.

With the construction shown, if the shaft 105 is rotated, then the rotor 112 will rotate, and there would be a reaction between the rotor and "stator" which would cause the stator to be driven thereby. However, according to the present invention it is necessary for the rotor not to be in driving contact with the stator. For this reason, the shaft 105 is keyed to a timing gear 115 and the end plate 107 is provided with a further timing gear 116. Timing belts 121 and 122 are passed around the timing gears 115 and 116, and also around further gears 117 and 118 on a parallel lay shaft 119 mounted in bearings 120. The number of teeth on the various timing gears is so chosen that the timing gear 116, and therefore the end plate 107 and thus the "stator" 110 will rotate at the desired speed so that there will be no driving connection between the stator and rotor, but both will be driven independently.

FIG. 2 shows schematically an arrangement of external gear drive to give the desired relative rotation or arrangements for the inner and outer member of the helical gear pump according to the invention. In FIG. 2 the gear wheels 130 and 131, having radiuses of $R_2$ and $R_1$ respectively are rotatable about centres A and B, these centres being displaced by the eccentricity e of their helical gear pump, compressor or motor.

The gears 130 and 131 mesh respectively with gears 133 and 132 having radiuses $R_4$ and $R_3$, these two gears being rotatable about the same axis C.

The relation of the radiuses to give the desired effect will be $$(R_2 \times R_3)/(R_4 \times R_1) = n/(n+1)$$

where n is the number of lobes of the rotor having the smaller number of lobes. This arrangement can, for example, be used in the construction of FIG. 1.

Thus, the construction of the present invention described includes a gear drive arrangement which is effective between the stator and the rotor to ensure that the rotor (and when necessary the stator also) rotate at the correct relative speed to ensure that no material contact is necessary between the stator and the rotor for the rotor to execute its desired path. This arrangement enables the pump to have a stator which is made of a material which is not resilient, as is conventional, but rather with a material such as stainless steel which would enable the pump to be used for a greater variety of purposes and at higher temperatures than hitherto. Furthermore, the arrangement is such as to enable very large eccentricities to be achieved and this factor will not be determined, as hitherto, by the constraints imposed upon the designer by the need to allow for the necessary orbiting motion to be secured by a flexible or double universal joint type of drive.

The pump can be caused to operate at a very high speed and can run dry, so that it can act as a compressor. Equally the arrangement could be used as a motor in which material such as mud, or liquid, is fed in at one end and discharged at the other, this causing rotation of the inner member relative to the outer member.

We claim:

1. A helical gear pump, compressor or motor including an inner member with an external helical gear form having n starts; an outer member with a cooperating internal helical gear form having $n \pm 1$ starts; at least one shaft rotatable about a first axis and connected to said inner member for rotation therewith; a support for supporting the outer member for rotation about a second axis laterally spaced from the first axis; and a geared connection between said inner and outer members, whereby the inner and outer members can rotate synchronously without any driving contact between the helical gear forms of the inner and outer members.

2. A helical gear pump, compressor or motor comprising an inner member with an external helical gear form having n starts; an outer member with a cooperating internal gear form having $n \pm 1$ starts; at least one shaft rotatable about a first axis and connected to said inner member for rotation therewith; a support for supporting the outer member for rotation about a second axis laterally spaced from said first axis; externally toothed gear wheels carried by said shaft and said support and a geared connection between the two externally toothed gear wheels for synchronizing rotation of the shaft and support, whereby the inner and outer members can rotate synchronously independently of any contact between the helical gear forms of the inner and outer members.

3. A helical gear pump, compressor or motor as claimed in claim 2, and further comprising pinions connected to said inner and outer members, and a gear train connected between said pinions externally of the outer member.

4. A helical gear pump, compressor or motor as claimed in claim 2, wherein said inner and outer members are constructed to have a lefthand pitch at one end and a righthand pitch at the other end, and further comprising a fluid connection in the outer member at a location of the change of pitch and a further fluid connection at each axial end of said outer member.

5. A helical gear pump, compressor or motor as claimed in claim 2, wherein the helical gear form of the inner and outer members is of cooperating tapered cross-section.

* * * * *